US005402213A

United States Patent [19]

Ikegawa et al.

[11] Patent Number: 5,402,213

[45] Date of Patent: Mar. 28, 1995

[54] CHARGING DEVICE FOR CHARGING OUTER SURFACE OF PHOTOSENSITIVE MEMBER INCLUDING CHARGING MEMBER FORMED BY A LAYER COMPRISING A COPOLYMER OF AN OLEFIN-TYPE VINYL MONOMER AND A FLUORINE-CONTAINED MONOMER

[75] Inventors: Akihito Ikegawa, Osaka; Masaki Asano, Amagasaki; Keiko Nagayasu; Masashi Yamamoto, both of Osaka, all of Japan

[73] Assignee: Minolta Camera Kabushiki Kaisha, Osaka, Japan

[21] Appl. No.: 152,195

[22] Filed: Nov. 12, 1993

[30] Foreign Application Priority Data

Nov. 20, 1992 [JP] Japan ..... 4-311802

[51] Int. Cl.[6] ..... G03G 15/02

[52] U.S. Cl. ..... 355/219; 361/225; 428/929; 430/902

[58] Field of Search ..... 355/219; 361/225, 230, 361/235; 428/929; 430/31, 902

[56] References Cited

U.S. PATENT DOCUMENTS

| | | | |
|---|---|---|---|
| 4,851,960 | 7/1989 | Nakamura et al. | 361/225 |
| 5,060,014 | 10/1991 | Adachi et al. | 355/211 |
| 5,068,762 | 11/1991 | Yoshihara | 361/225 |
| 5,192,974 | 3/1993 | Ikegawa et al. | 355/219 |
| 5,278,614 | 1/1994 | Ikegawa et al. | 355/219 |

FOREIGN PATENT DOCUMENTS 3-293682 12/1991 Japan .

*Primary Examiner*—William J. Royer

*Attorney, Agent, or Firm*—Willian Brinks Hofer Gilson & Lione

[57] ABSTRACT

A contact charging device for charging an outer surface of an electrostatic latent image carrier in contact therewith which has a charging member at least partly in contact with the electrostatic latent image carrier, the portion of the charging member in contact with the electrostatic latent image carrier being formed by a layer containing a copolymer of an olefin-type vinyl monomer and a fluorine-contained monomer, and a power supply for applying a charging voltage to the charging member.

12 Claims, 4 Drawing Sheets

CHARGING DEVICE FOR CHARGING OUTER SURFACE OF PHOTOSENSITIVE MEMBER INCLUDING CHARGING MEMBER FORMED BY A LAYER COMPRISING A COPOLYMER OF AN OLEFIN-TYPE VINYL MONOMER AND A FLUORINE-CONTAINED MONOMER

BACKGROUND OF THE INVENTION

1. Field of the Invention

The present invention relates to contact charging devices for charging the outer peripheral surface of a photosensitive member in contact therewith for use in image forming apparatus such as copying machines and printers.

2. Description of the Background Art

Electrophotographic copying machines, printers and like image forming apparatus produce copies or prints by charging a photosensitive member with a charging device, exposing the charged region of the member to an optical image to form an electrostatic latent image, developing the latent image to a visible image, transferring the image to a sheet and fixing the image thereto.

Various types of charging devices are known which are classified generally into corona charging devices utilizing corona discharge, and contact-type charging devices having a charging brush, charging roller, blade or drivingly rotatable endless charging belt adapted to contact the surface of the photosensitive member.

The charging device utilizing corona discharge has the advantage of giving charges with good stability but has the problem of producing a large amount of ozone, which deteriorates the photosensitive member and adversely affects the human body, so that attention has been directed to the contact charging device which is much smaller than the corona charging device in the amount of ozone to be produced.

However, the use of the contact charging device involves the problem that toner particles remaining on the photosensitive member or particles of the photosensitive material adhere to the charging member, permitting the particle-adhered portion to cause uneven charging to produce irregularities in images.

Accordingly, the main object of the present invention is to provide a highly reliable charging device which is capable of affording a uniform charged state with good stability over a long period of time unlike the conventional contact charging device.

SUMMARY OF THE INVENTION

The present invention has been accomplished to fulfill the above object.

The present invention relates to a contact charging device which comprises a charging member at least partly in contact with a photosensitive member, the portion of the charging member in contact-with the photosensitive member being formed by a layer comprising a copolymer of an olefin-type vinyl monomer and a fluorine-contained monomer, and power supply means for applying a charging voltage to the charging member.

A charging roller, blade, film or brush is usable as the charging member of the invention. Among these, the charging film ms desirable for use as the charging member since it is simple in construction and inexpensive.

The charging film is in the form of a flexible film having one end supported by a support member disposed in parallel to the photosensitive member, and a free end in contact over a predetermined width with the outer peripheral surface of the photosensitive member.

When the power supply means impresses a voltage on the charging film with the photosensitive member in rotation, the portion of the charging film in contact with the photosensitive member is held in intimate contact with the member by electrostatic attraction due to a potential difference between the film and the member. Consequently, discharge occurs in the vicinity of region of contact between the photosensitive member and the charging film, charging the outer peripheral surface of the photosensitive member with good stability over the region of contact between the film and the member. The presence of the copolymer of fluorine-contained monomer and olefin-type vinyl monomer in the contact portion of the film gives an excellent nonadhering property and high abrasion resistance to this portion to eliminate the likelihood that toner particles or the like on the photosensitive member will adhere to the portion and ensure stabilized charging.

DESCRIPTION OF THE PREFERRED EMBODIMENTS

Embodiments of the invention will be described below with reference to the accompanying drawings.

Figure 1:
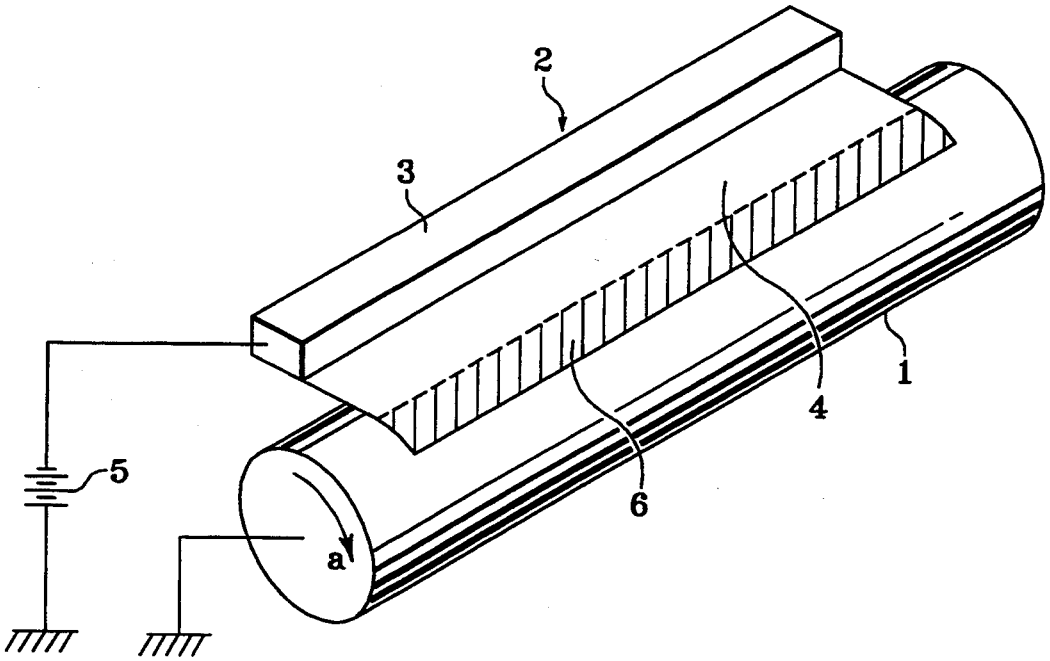
FIG. 1 is a perspective view of a charging device embodying the invention.

FIG. 1 shows a photosensitive member 1 of the function-separated type in the form of a drum and comprising an organic photosensitive material.

More specifically, the photosensitive member 1 comprises a cylindrical aluminum substrate, and a charge producing layer having a thickness of 0.4 μm and formed over the outer periphery of the substrate by applying a photosensitive coating composition to the substrate by dipping and drying the coating. The photosensitive coating composition is prepared from 1 part by weight of τ type metal-free phthalocyanine, 2 parts by weight of polyvinyl butyral resin (up to 3 mole % in acetylation degree, 70 mole % in butylation degree and 1000 in polymerization degree) and 100 parts by weight of tetrahydrofuran by placing these compounds into a ball mill pot and treating them for 24 hours to obtain a dispersion.

Formed over the charge producing layer is a charge transport layer having a thickness of 18 μm and prepared by coating the layer with a composition by dipping and drying the resulting coating. This coating composition is prepared by dissolving 8 parts by weight of a hydrazone compound represented by the formula (1)

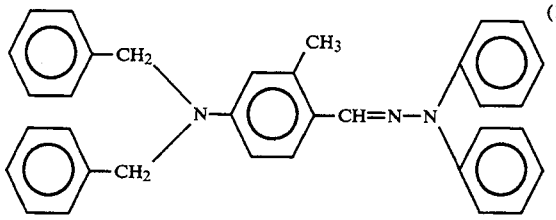

(1)

0.1 part by weight of an orange pigment Sumiplast Orange 12, product of Sumitomo Chemical Co., Ltd.) and 10 parts by weight of polycarbonate resin (Panlite L-1250, product of Teijin Kasei Co., Ltd.) in 180 parts by weight of tetrahydrofuran serving as a solvent.

The photosensitive member 1 is in no way limited with respect to its material, nor is it limited to the function-separated type; the member can be an organic photosensitive member of single-layer structure. The charge producing material, charge transport material, binder resin, etc. can be any of those known. Also usable are inorganic materials such as zinc oxide, cadmium sulfide, selenium alloy and amorphous silicon.

The outermost surface of the photosensitive member may be covered with a surface protective layer, which can be made of a resin such as resin curable with ultraviolet rays or at room temperature or thermosetting resin, or such a resin having a resistance adjusting material dispersed therein. Also usable are a thin film of metal oxide, metal sulfide or the like which is formed, for example, by evaporation or ion plating in a vacuum, amorphous carbon film formed by the plasma polymerization of a hydrocarbon gas, and the like.

The material for the substrate is not limited specifically insofar as it is electrically conductive. In the case where the light source used produces coherent light, the substrate may be rough-surfaced, colored black or otherwise processed to prevent occurrence of a so-called interference pattern.

Next, indicated at 2 is a charging device which comprises a support member 3 disposed alongside the photosensitive member 1 in parallel thereto, and a charging film 4 in the form of a strip of flexible sheet. The film 4 has one end extending longitudinally thereof, secured to the support member 3 and connected to a charging power supply 5. The charging film 4 has a free end extending longitudinally thereof and lightly contacting the outer peripheral surface of the photosensitive member 1 with substantially no contact pressure.

Figure 4:
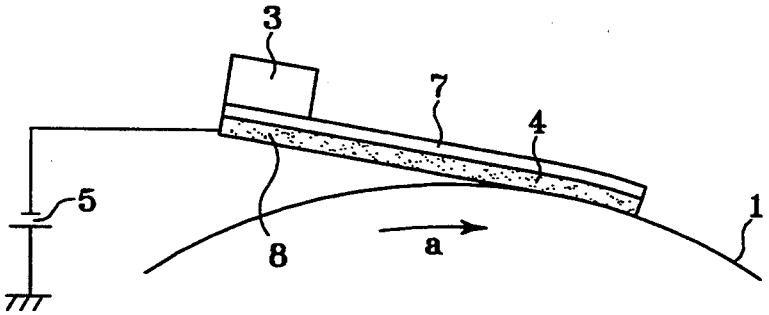
FIG. 4 is a diagram showing a method of electrical connection to the charging film.
Figure 5:
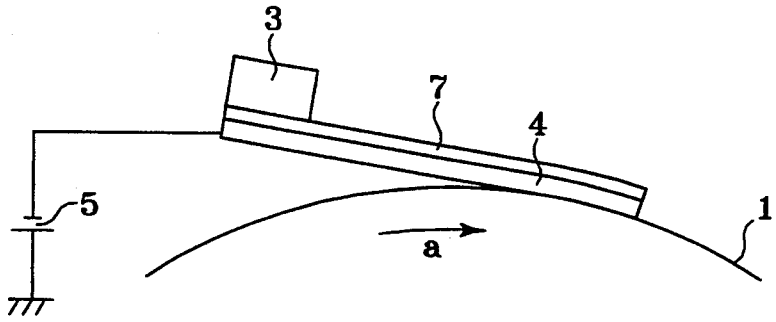
FIG. 5 is a diagram showing another method of electrical connection to the charging film.

The charging film 4 to be used is a thin sheet prepared from a copolymer of a fluorine-contained monomer and an olefin-type vinyl monomer, with an electrically conductive material dispersed in the copolymer when so desired, or a sheet comprising a substrate made of metal material or a synthetic resin and coated with the above copolymer over each surface, one surface or at least the surface portion (contact portion 6) thereof to be in contact with the photosensitive member 1, or a sheet comprising such a substrate coated with the copolymer containing an electrically conductive material as dispersed therein. Electrically connected to the power supply 5 is the charging film 4 containing a conductive material 8 dispersed therein if the substrate 7 has an insulating property as shown in FIG. 4, or the substrate 7 when the substrate 7 is conductive as seen in FIG. 5.

According to the present invention, the charging film 4 has a strength which is preferably about $1\times10^{-4}$ g.cm to about 20 g.cm in terms of the bending moment M thereof because if the bending moment is in excess of 20 g.cm, the charging film 4 encounters difficulty in properly contacting the photosensitive member 1, permitting uneven charging of the surface of the member and consequently producing image noise, and further because if the moment is less than $1\times10^{-4}$ g.cm, the low strength is likely to result in troubles. In the case where the charging film 4 comprises a substrate and the copolymer of the invention coating the substrate, the optimum value of bending moment is a value determined for these components as joined together and is not a value for the substrate or the coating alone.

Figure 3:
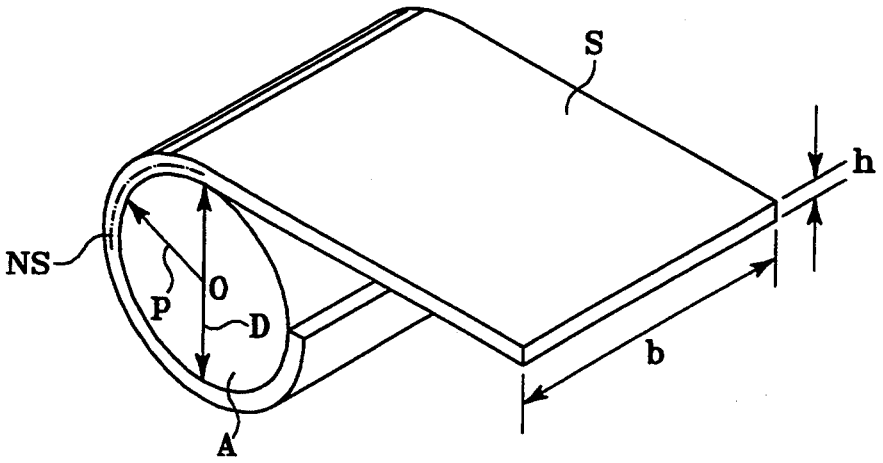
FIG. 3 is a diagram showing a method of measuring the strength of a charging film.

With reference to FIG. 3, the bending moment M is the moment required for winding a charging film S having a width b (=1 cm) around a rod A having a circular cross section with an outside diameter D (=1 cm), and is a value calculated from $M=EI/\rho$ ($I=bh^3/12$) where E is the Young's modulus (g/cm$^2$) of the charging film, I is the moment of inertia of area (cm$^4$) of the film, $\rho$ is the radius of curvature (cm) of the film which is the distance between the center of curvature, i.e., the center O of the rod A, and the neutral line NS of the film, and h ms the thickness of the film.

Examples of suitable copolymers are a tetrafluoroethylene-perfluoropropylene copolymer of the structural formula 2 given below, ethylene-tetrafluoroethylene copolymer of the structural formula 3 and tetrafluoroethylene-perfluoroalkyl vinyl ether copolymer of the structural formula 4. These copolymers comprise tetrafluoroethylene because tetrafluoroethylene is more excellent in slip and nonadhering properties than various other fluorine-contained resins and is relatively superior thereto in productivity and formability. Tetrafluoroethylene is used as polymerized with an olefin-type vinyl monomer because this resin, if used singly, is susceptible to wear and can not be made into a film.

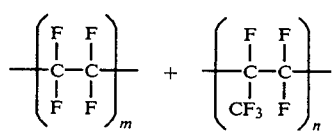

(2)

m, n ≧ 1

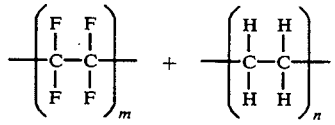

(3)

m, n ≧ 1

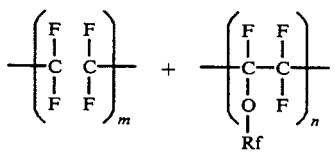

(4)

Rf: alkyl group
m, n ≧ 1

Preferably, the olefin-type monomer has about 2 to about 12 carbon atoms. If the number of carbon atoms is less than this range, it is difficult for the copolymer to exhibit an enhanced strength, whereas if the number exceeds the range, it is likely that the nonadhering property of tetrafluoroethylene will be adversely effected. Further the proportion of the olefin-type vinyl monomer in the copolymer is preferably about 5 to about 30 wt. % based on the entire copolymer. Like the number of carbon atoms, this proportion is determined in view of the balance between the strength and the nonadhering property.

Next, materials useful for the substrate will be exemplified.

Examples of useful metal materials are metals such as aluminum, gold, copper, iron, silver, chromium, nickel, platinum, tin and titanium, and alloys of such metals.

Examples of useful synthetic resins are polyethylene, polypropylene and like polyolefin resins, polyvinyl alcohol, polyvinyl acetate and like polyacetal resins, ethylene-vinyl acetate copolymer, methyl polymethacrylate, acrylonitrile-methyl acrylate copolymer and like acrylic resins, polycarbonate, polystyrene, acrylonitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose and like cellulose resins, nylon 6, nylon 66, nylon 11, nylon 12, nylon 46 and like polyamide resins, polyimide, polysulfone, polyether sulfone, polyvinyl chloride, vinyl chloride-vinyl acetate copolymer, polyvinylidene chloride, vinylidene chloride-vinyl chloride copolymer, polytetrafluoroethylene, polychlorofluoroethylene, polyvinyl fluoride, polyvinylidene fluoride and like polyvinyl halide resins and vinyl nitrile rubber alloy.

Examples of electrically conductive materials which may be dispersed in the copolymer are metal powder, metal whisker, carbon black, carbon fiber, etc. When incorporating such a material, the copolymer affords a low-resistance material of about 10 to about $10^8$ ohm.cm which still remains to be nonconductive. The amount of conductive material to be present is preferably about 10 to about 30% so as to avoid the possible influence on the strength.

With the charging device 2 of the foregoing construction, a voltage is applied to the charging film 4 by the power supply 5 with the photosensitive member 1 in rotation in the direction of arrow a, whereupon the portion 6 of the film 4 in contact with the photosensitive member 1 is brought into intimate contact with the member 1 by electrostatic attraction due to a potential difference between the film 4 and the member 1, and discharge occurs in the vicinity of region of contact between the photosensitive member 1 and the charging film 4. After the outer peripheral surface of the member 1 has been charged to a predetermined potential, the region of contact between the film 4 and the member 1 (i.e., the contact portion 6) ensures stabilized charging.

The charging film of the charging device embodying the present invention was tested for charging characteristics by the following experiment.

Figure 2:
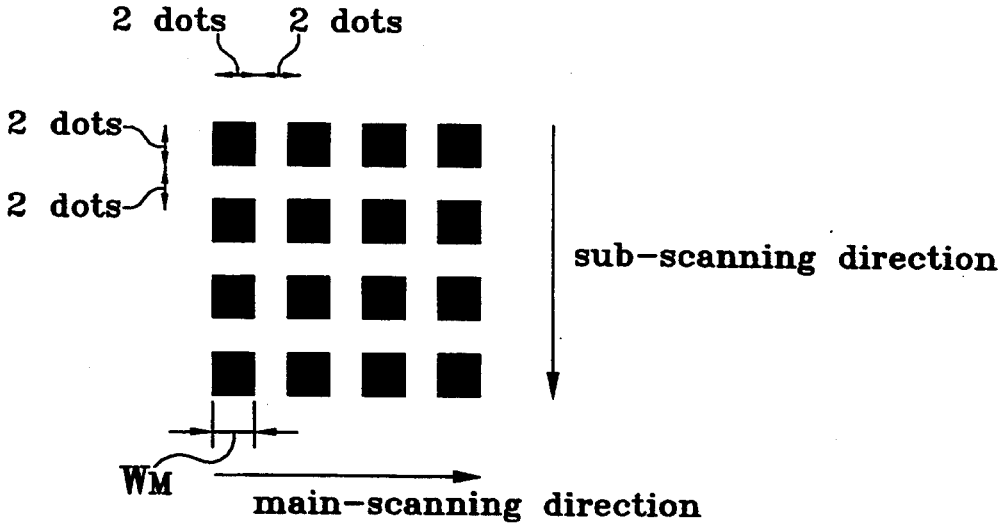
FIG. 2 is a diagram for illustrating a pattern prepared by an experiment.

On a photosensitive member charged by the charging device, a latticelike pattern was produced by repeatedly turning on and off an unillustrated laser to form two-dot on areas and two-dot off areas alternately arranged in both the main scan direction (axial direction of the photosensitive member) and the subscan direction (direction of rotation of the member) as shown in FIG. 2 until 30 two-dot on areas were formed in the main scan direction, and developing the resulting image. This procedure was repeated to obtain prints, and the width of solid black areas of the pattern with respect to the main scan direction (see FIG. 2 was measured every specified number of prints. The standard deviation a was determined for the maximum widths $W_M$ of the patterns, for use in evaluating the image noise according to the criteria listed below.

TABLE 1

| Standard deviation | Criteria of evaluation |
|---|---|
| $0\ \mu m \leqq \sigma < 10\ \mu m$ | 5 (No problem for use) |
| $10\ \mu m \leqq \sigma < 20\ \mu m$ | 4 (The same above) |
| $20\ \mu m \leqq \sigma < 30\ \mu m$ | 3 (Acceptable limit for use) |
| $30\ \mu m \leqq \sigma < 40\ \mu m$ | 2 (Unacceptable) |
| $40\ \mu m \leqq \sigma$ | 1 (The same above) |

The charging film 4 used was prepared from a tetrafluoroethylene-perfluoropropylene copolymer represented by the structural formula 2 and having dispersed therein 15 wt. % of carbon black as a conductive material, and was 75 μm in thickness, $5.5\times10^7$ ohm/□ in surface resistivity and $1.0\times10^8$ ohm.cm in volume resistivity. A charging voltage of −1200 V was impressed on the charging film.

For comparison, a charging film was also tested which was prepared from nylon having 20 wt. % of carbon black dispersed therein and which was 100 μm in thickness, $1.4\times10^6$ ohm/□ in surface resistivity and $9.0\times10^3$ ohm.cm in volume resistivity. The charging applied was similarly −1200 V.

Figure 6:
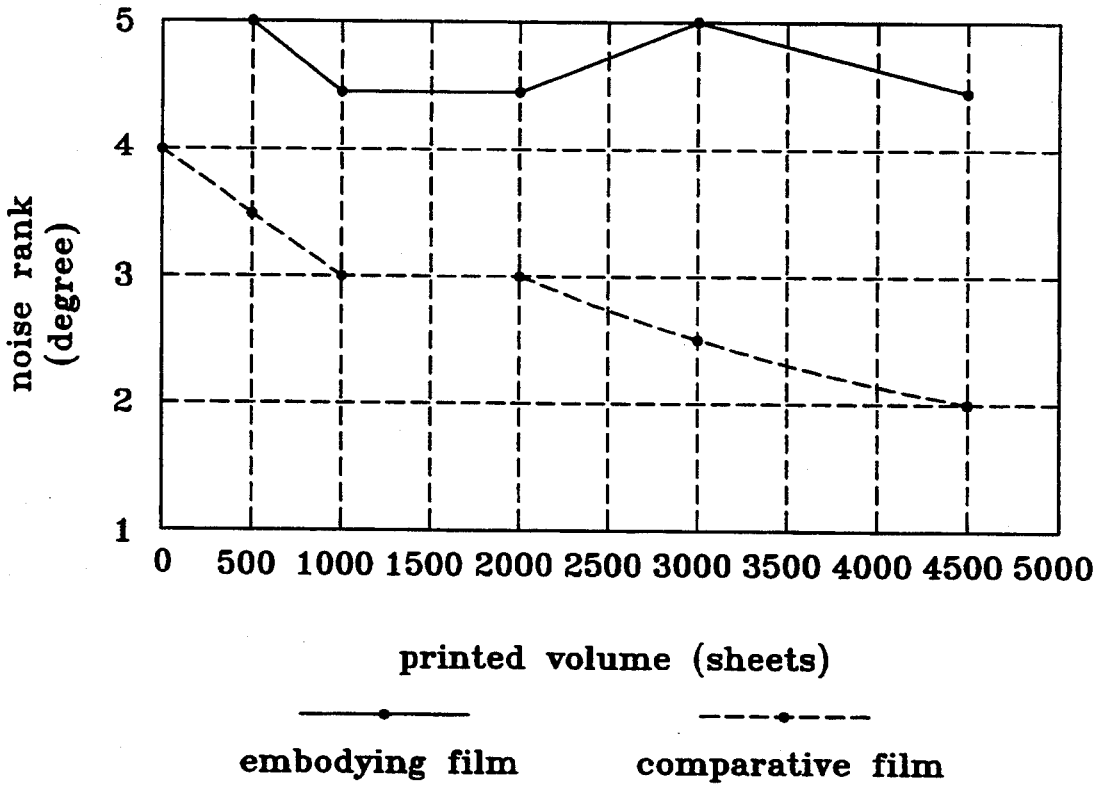
FIG. 6 is a diagram showing the experimental results obtained by checking charging films-for image noise.

The experimental results are shown in FIG. 6, which indicates that the charging film embodying the invention remained usable with greatly diminshed image noise despite the increase in the number of printed sheet. With the comparative charging film, however, the image noise became pronounced with an increase in the number of printed sheets and reached an unacceptable level for use when 4500 prints were produced.

The portion of each charging film in contact with the photosensitive member was also visually inspected for soil every time 500 sheets had been printed. Consequently, the charging film of the invention was found free from adhering toner or like soil, whereas the comparative charging film became increasingly soiled owing to adhesion of the toner with an increase in the number of prints.

With the charging device of the present invention, the contact portion of the charging film is formed by a material comprising a copolymer of tetrafluoroethylene and other fluorocarbon or ethylene, and a conductive substance incorporated in the copolymer, i.e., a nonadhering and abrasion-resistant material. This assures the charging film of stabilized charging characteristics over a prolonged period of time without permitting fine toner particles and like extraneous matter remaining on the photosensitive member to adhere to the contact portion of the film as will be apparent from the foregoing description.

The invention further makes the charging device compact, easy to install and simple in construction.

Figure 7:
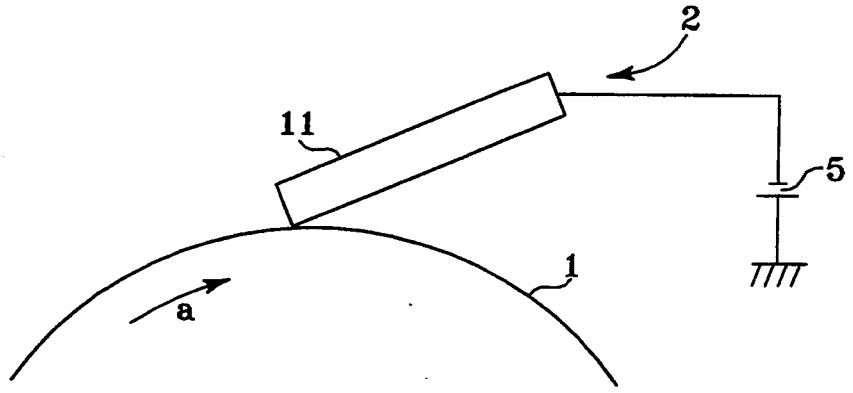
FIG. 7 is a diagram showing a charging member in the form of a charging blade.
Figure 8:
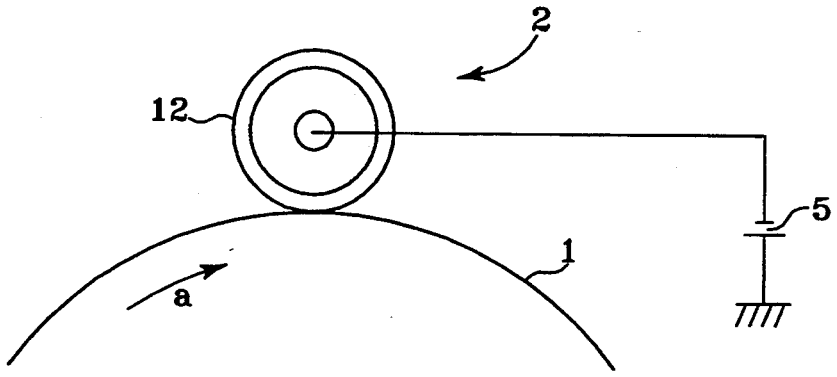
FIG. 8 is a diagram showing a charging member in the form of a charging roller.
Figure 9:
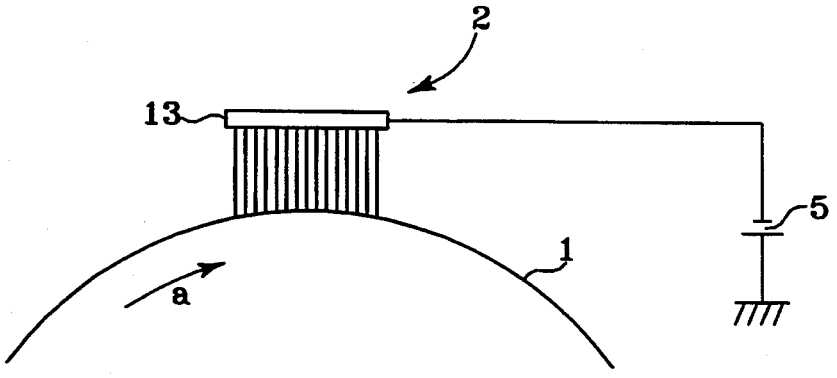
FIG. 9 is a diagram showing a charging member in the form of a charging brush.

In the above description, the charging member is described as being in the form of a charging film. It should be recognized, however, that the charging member could also take other forms including a blade form, a roller form and a brush form. Such alternative embodiments are illustrated in FIGS. 7–9 wherein FIG. 7 illustrates a charging device 2 having a charging member in the form of a charging blade 11, FIG. 8 illustrates a charging device 2 having a charging member in the form of a charging roller 12, and FIG. 9 illustrates a charging device 2 having a charging member in the form of a charging brush 13.

What is claimed is:

1. A contact charging device for charging an outer surface of an, electrostatic latent image carrier in contact therewith which comprises a charging member at least partly in contact with the electrostatic latent image carrier, the portion of the charging member in contact with the electrostatic latent image carrier being formed by a layer comprising a copolymer of an olefin-type vinyl monomer and a fluorine-contained monomer, and power supply means for applying a charging voltage to the charging member.

2. A contact charging device of claim 1, wherein said olefin-type vinyl monomer has about 2 to about 12 carbon atoms.

3. A contact charging device of claim 1, wherein said copolymer contains the olefin-type vinyl monomer of about 5 to about 30% by weight.

4. A contact charging device of claim 1, wherein said copolymer is at least one selected from the group consisting of a tetrafluoroethylene-perfluoropropylene copolymer, an ethylene-tetrafluoroethylene copolymer and tetrafluoroethylene-perfluoroalkyl vinyl ether copolymer.

5. A contact charging device of claim 1, wherein said charging member has a form selected from the group consisting of a film form, a blade form, a roller form and a brush form.

6. A contact charging device for charging an outer surface of an electrostatic latent image carrier in contact therewith which comprises:

a charging member comprising a support member and a charging film which is in the form of a flexible film having one end supported by the support member and a free end in contact with the outer surface of the electrostatic latent image carrier, the portion of the charging film in contact with the electrostatic latent image carrier being formed by a layer comprising a copolymer of an olefin-type vinyl monomer and a fluorine-contained monomer, and power supply means for applying a charging voltage to the charging member.

7. A contact charging device of claim 6, wherein said olefin-type vinyl monomer has about 2 to about 12 carbon atoms.

8. A contact charging device of claim 6, wherein said copolymer contains the olefin-type vinyl monomer of about 5 to about 30% by weight.

9. A contact charging device of claim 6, wherein said copolymer is at least one selected the group consisting of a tetrafluoroethylene-perfluoropropylene copolymer, an ethylene-tetrafluoroethylene copolymer and tetrafluoroethylene perfluoroalkyl vinyl ether copolymer.

10. A contact charging device of claim 6, wherein said support member is made of metal material or synthetic resin.

11. A contact charging device of claim 10, wherein said synthetic resin contains an electrically conductive material.

12. A contact charging device of claim 6, wherein said charging film contains an electrically conductive material.

* * * * *

UNITED STATES PATENT AND TRADEMARK OFFICE

CERTIFICATE OF CORRECTION

PATENT NO. : 5,402,213

DATED : March 28, 1995

INVENTOR(S) : Akihito Ikegawa, et al

It is certified that error appears in the above-indentified patent and that said Letters Patent is hereby corrected as shown below:

In col. 1, line 56, after "contact" delete "-" (hyphen).

In col. 1, line 64, change "ms" to --is--.

In col. 4, line 26, change "ms" to --is--.

In col. 6, line 2, change "a" to --σ--.

In col. 7, line 5 (Claim 1, line 2), after "an" delete "," (comma).

In col. 8, line 20 (Claim 9, line 2), after "selected" insert --from--.

Signed and Sealed this

Fifth Day of September, 1995

*Attest:*

Bruce Lehman

BRUCE LEHMAN

*Attesting Officer*

*Commissioner of Patents and Trademarks*